US011140925B2

(12) United States Patent
Chuang et al.

(10) Patent No.: US 11,140,925 B2
(45) Date of Patent: Oct. 12, 2021

(54) SCULPTING CLOTHING CAPABLE OF QUICK ASSEMBLY, DISASSEMBLY AND REPLACEMENT OF CLOTHING PIECES

(71) Applicants: Pi-Yu Chuang, Taipei (TW); Ming-Hua Teng, Taipei (TW); Jen-Lung Teng, Taipei (TW); Chia-Chia Chuang, Taipei (TW)

(72) Inventors: Pi-Yu Chuang, Taipei (TW); Ming-Hua Teng, Taipei (TW); Jen-Lung Teng, Taipei (TW); Chia-Chia Chuang, Taipei (TW)

( * ) Notice: Subject to any disclaimer, the term of this patent is extended or adjusted under 35 U.S.C. 154(b) by 78 days.

(21) Appl. No.: 16/654,015

(22) Filed: Oct. 16, 2019

(65) Prior Publication Data

US 2021/0112883 A1 Apr. 22, 2021

(51) Int. Cl.
*A41C 1/14* (2006.01)

(52) U.S. Cl.
CPC ..... *A41C 1/14* (2013.01)

(58) Field of Classification Search
CPC ..... A41C 1/14
USPC ..... 450/5, 8–10, 15–18, 24–26, 28, 143
See application file for complete search history.

(56) References Cited

U.S. PATENT DOCUMENTS 690,898 A * 1/1902 Smith
1,267,657 A * 5/1918 Grace ..... A41C 1/06 450/18
2,593,832 A * 4/1952 Barcley ..... A41C 1/06 450/18
2,717,602 A * 9/1955 Radler ..... A61F 2/52 623/7
2,900,984 A * 8/1959 Cunningham ..... A41C 1/00 450/132
4,268,938 A * 5/1981 Walchli ..... A44B 19/28 24/585.12
5,628,064 A * 5/1997 Chung ..... A41D 15/00 2/119
5,938,500 A * 8/1999 Hampton ..... A41C 1/06 450/32
6,009,604 A * 1/2000 Fildan ..... A41F 1/006 24/318
6,319,092 B1 * 11/2001 Leyhe ..... A41C 3/0071 450/36

(Continued)

*Primary Examiner* — Gloria M Hale
(74) *Attorney, Agent, or Firm* — Leong C. Lei

(57) ABSTRACT

A piece of sculpting clothing capable of quick assembly, disassembly and replacement of clothing pieces includes clothing pieces and first, second tightening clothing pieces, where the two sides of each clothing piece are respectively configured with longitudinally arranged first, second fasteners, allowing the clothing pieces pieced together. The first, second tightening clothing pieces are also respectively configured with longitudinally arranged first, second fasteners engaging with the first, second fasteners of clothing pieces, forming a complete piece of sculpting clothing. The clothing pieces enable the quick assembly of a piece of sculpting clothing that conforms to the shape and size of a wearer, thereby substantially reducing customization cost and labor. The first, second fasteners also jointly form a rib structure providing a longitudinal support to the wearer's torso. The present invention therefore completely eliminates the shortcoming of traditional sculpting clothing that must be additionally installed with metal supporting bars.

6 Claims, 7 Drawing Sheets

(56) References Cited

U.S. PATENT DOCUMENTS

| | | | | |
|---|---|---|---|---|
| 6,575,811 | B1 * | 6/2003 | Fildan | A41C 3/0071 450/41 |
| 8,122,587 | B2 * | 2/2012 | Kawashima | H03H 9/21 29/594 |
| 2009/0259159 | A1 * | 10/2009 | Bell | A61F 13/145 602/75 |
| 2010/0159802 | A1 * | 6/2010 | Abbaszadeh | A41C 3/04 450/36 |
| 2013/0326788 | A1 * | 12/2013 | Bell | A41C 1/00 2/113 |
| 2019/0336662 | A1 * | 11/2019 | Ewusi-Emmim | A61J 15/0011 |

* cited by examiner

SCULPTING CLOTHING CAPABLE OF QUICK ASSEMBLY, DISASSEMBLY AND REPLACEMENT OF CLOTHING PIECES

BACKGROUND OF THE INVENTION

(a) Technical Field of the Invention

The present invention is generally related to corsets or shapewears, and more particular to a sculpting garment capable of quick assembly, disassembly, and replacement of clothing pieces.

(b) Description of the Prior Art

To help modern women achieving more appealing and attractive body shape, there are shapewears or sculpting garments worn to train or slim the bodies into desired shapes.

A conventional sculpting garment is usually of a single-piece design and custom-made specifically for a wearer. It is therefore quite costly and laborious to make based on accurate measurement of the wearer's torso and breasts. Once made, the sculpting garment also has to be continuously altered as the wearer becomes thinner or wider.

Due to the high cost, consumers often expect their sculpting garments may last for an expanded period of time. However, as the wearer ages or leads a different life style, the body shape inevitably changes, especially after pregnancy. Then, the single-piece sculpting garment no longer fits well. In addition, the sculpting garment may be worn out, frayed, damaged, or obsolete. Then, a new sculpting garment has to be ordered at additional expense.

Therefore, there are sculpting garments made by a number of pieces zippered together. Then, by including or remove one or more pieces, the sculpting garment may be adapted to the change of wearer's body shape without inventing on a new sculpting garment.

However, zippers are often made of a flexible material. A sculpting garment formed by zippered pieces thereby lacks adequate longitudinal support and the sculpting garment is too saggy to train the wearer's torso and to make it conform to a fashionable silhouette. Furthermore, a zipper may be easily broken down if some of its teeth is worn out or damaged, rendering the entire sculpting garment incapable of disassembly and proper use.

SUMMARY OF THE INVENTION

To obviate the above shortcomings, a novel sculpting garment capable of quick assembly, disassembly, and replacement of clothing pieces are disclosed. The sculpting garment includes a number of clothing pieces, a first tightening clothing piece, and a second tightening clothing piece. Each clothing piece has a first longitudinal edge and a second longitudinal edge, a number of first fasteners are sequentially arranged at intervals along the first longitudinal edge, a number of second fasteners are sequentially arranged at intervals along the second longitudinal edge. A number of first fasteners are sequentially arranged at intervals along a longitudinal edge of the first tightening clothing piece. A number of second fasteners are sequentially arranged at intervals along a longitudinal edge of the second tightening clothing piece. The clothing pieces are laterally pieced together by having adjoining clothing pieces' the first and second fasteners along their respective first and second longitudinal edges detachably engage each other. The first fasteners of the first tightening clothing piece detachably engage dangling second fasteners on a laterally outermost clothing piece. The second fasteners of the second tightening clothing piece detachably engage dangling first fasteners on another laterally outermost clothing piece. The first and second fasteners are made of an inflexible material. The engaged first and second fasteners between clothing pieces, between clothing pieces and first and second tightening clothing pieces jointly form a number of longitudinal rib structures to provide rigid and vertical support to a wearer's torso.

The gist of the present invention lies in that the first tightening clothing piece, second tightening clothing piece, and clothing pieces have longitudinally arranged first fasteners and second fasteners along their longitudinal edges. The first tightening clothing piece, second tightening clothing piece, and clothing pieces are thereby may be quickly assembled into a sculpting garment fitting nicely over a wearer's body and disassembled. The sculpting garment's production cost and effort is as such greatly reduced.

Additionally, the first fasteners and second fasteners are made of an inflexible material such as inflexible plastic material. As the sculpting garment is assembled and the first fasteners and second fasteners are engaged, they jointly form a number of longitudinal rib structures to provide rigid and vertical support to the wearer's torso, thereby avoiding the embedment of metallic rods in a conventional sculpting garment.

Furthermore, the first and second fasteners are independent. When one or few of the first and second fasteners are broken, the other functional first fasteners and second fasteners may still engage with each other without affecting the assembly and disassembly function of the first tightening clothing piece, second tightening clothing piece, and clothing pieces.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
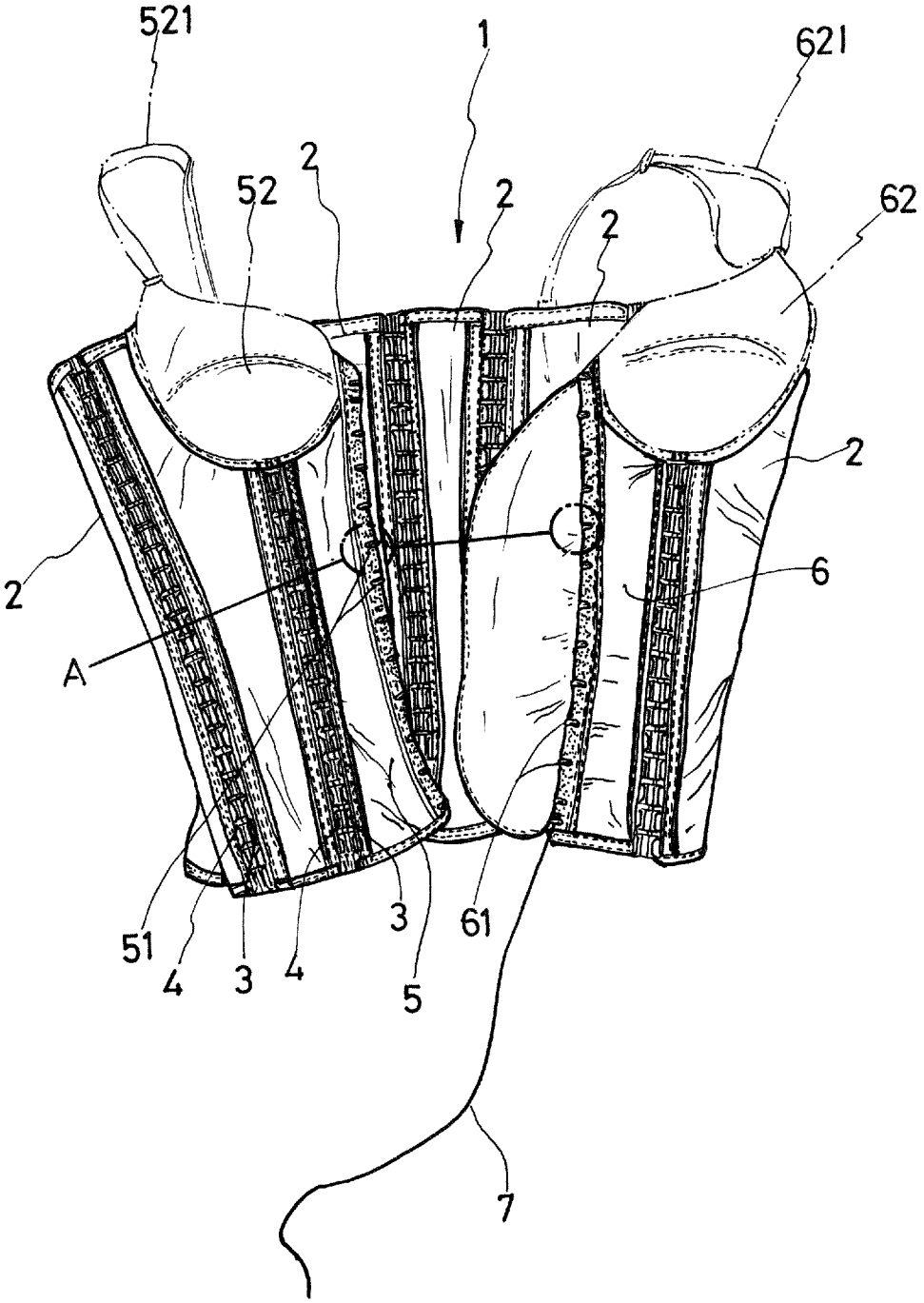
FIG. 1 is a perspective diagram showing a sculpting garment according to an embodiment of the present invention.
Figure 2:
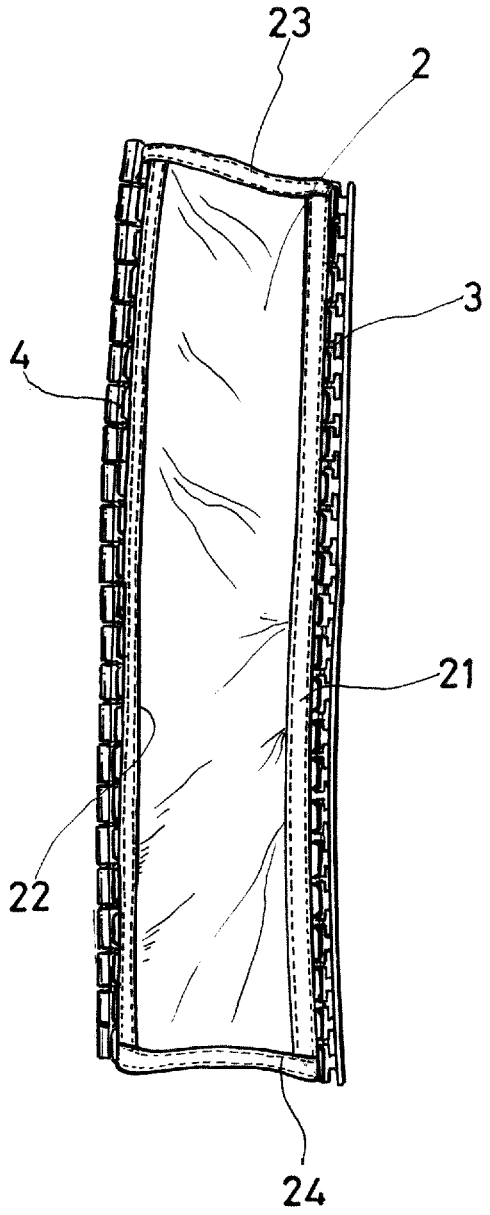
FIG. 2 is a perspective diagram showing a clothing piece of the sculpting garment of FIG. 1.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 9, a sculpting garment 1 according an embodiment of the present invention includes a number of clothing pieces 2, a first tightening clothing piece 5, and a second tightening clothing piece 6.

Each clothing piece 2 has a first longitudinal edge 21, a second longitudinal edge 22, an upper edge 23, and a lower edge 24. Each clothing piece 2 has a number of first fasteners 3 arranged at intervals along the first longitudinal edge 21, and a number of second fasteners 4 arranged at intervals along the second longitudinal edge 22.

Figure 3:
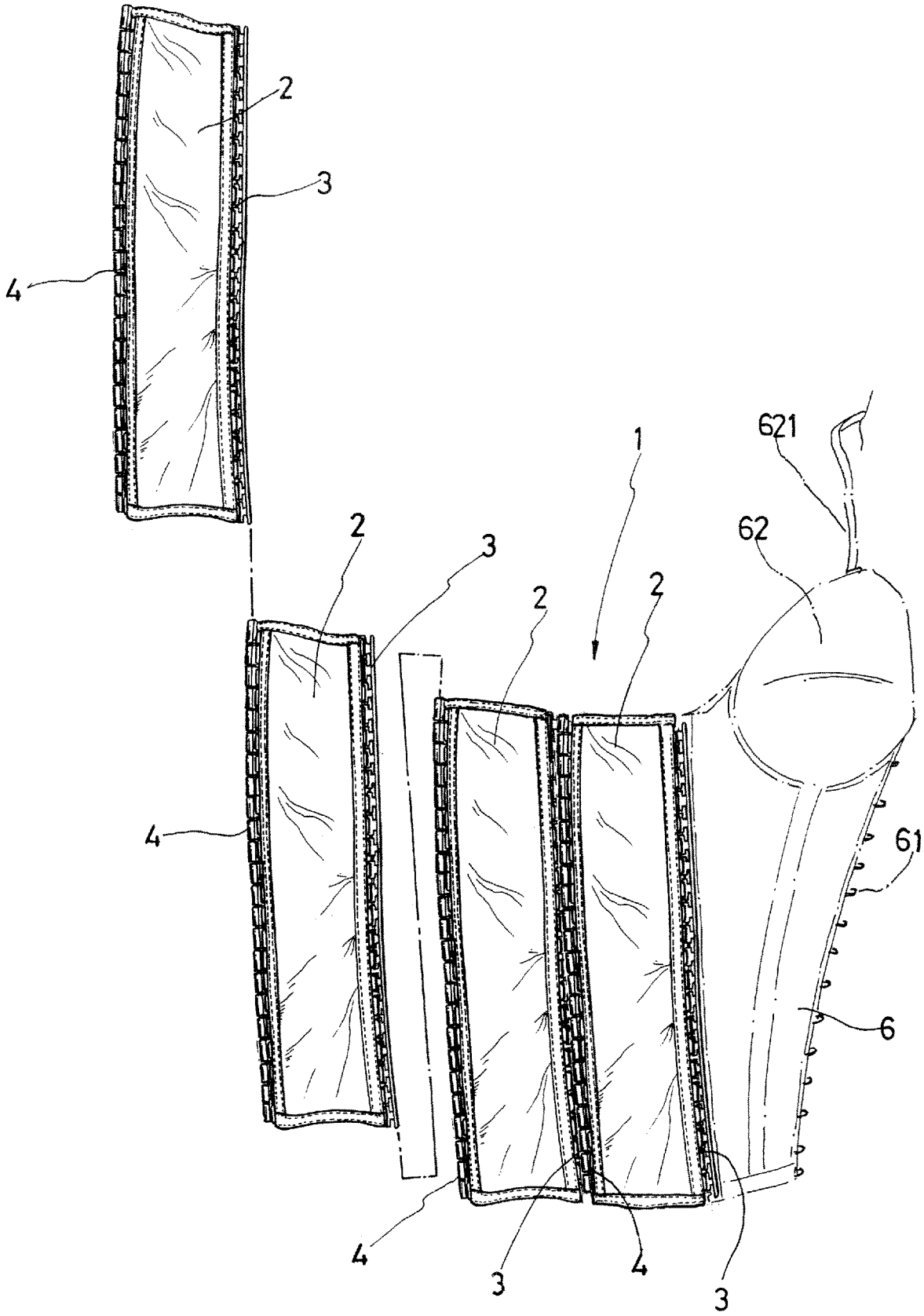
FIG. 3 is a perspective diagram showing clothing pieces of FIG. 2 are pieced together.

As shown in FIG. 3, the first fasteners 3 on a clothing piece 2 detachably engages the second fasteners 4 of another clothing piece 2. Multiple clothing pieces 2 are thereby pieced together edge to edge into a major portion of the sculpting garment 1 with dangling, un-engaged first fasteners 3 from a clothing piece 2 at an end and dangling, un-engaged second fasteners 4 from another clothing piece 2 at the other end of the major portion of the sculpting garment 1. The major portion of the sculpting garment 1 may cover the back, waist, or part of abdomen region of a wearer's torso. The clothing pieces 2 may be made of an inflexible fabric material. The upper edge 23 of each clothing piece 2 may have a greater width than that of its lower edge 24. A middle section of each clothing piece 2 has a smaller width than that of the lower edge 24. As such, the major portion of the sculpting garment 1 formed by piecing clothing pieces 2 together may fit better to the curves of the wearer's back, waist, and abdomen.

The first tightening clothing piece 5 has a number of first fasteners 3 along a longitudinal edge, and a number of first hooks 51 along the other longitudinal edge of the first tightening clothing piece 5. The first fasteners 3 of the first tightening clothing piece 5 engage the dangling second fasteners 4 on the major portion of the sculpting garment 1, as shown in FIG. 1, so that the first tightening clothing piece 5 is laterally joined to the clothing pieces 2. The first tightening clothing piece 5 has a first cup 52 along its upper edge, and the first cup 52 is connected to a first shoulder strap 521. The first tightening clothing piece 5 covers the wearer's breast and the right region of his/her abdomen.

The second tightening clothing piece 6 is for engaging the first tightening clothing piece 5. The second tightening clothing piece 6 has a number of second fasteners 4 along a longitudinal edge and a number of second hooks 61 along the other longitudinal edge of the second tightening clothing piece 6. The second fasteners 4 of the second tightening clothing piece 6 engage the dangling first fasteners 3 of the major portion of the sculpting garment 1, as shown in FIG. 3, so that the second tightening clothing piece 6 is laterally joined to the clothing pieces 2. The second tightening clothing piece 6 has second cup 62 along its upper edge, and the second cup 62 is connected to a second shoulder strap 621. The second tightening clothing piece 6 covers the wearer's breast and the left region of his/her abdomen.

Figure 9:
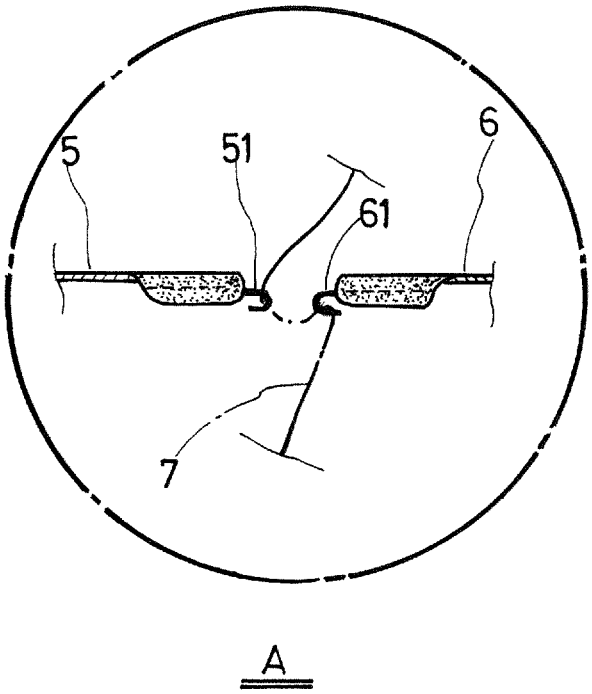
FIG. 9 is a top-view diagram showing a strap tightening the sculpting garment of FIG. 1.

The first hooks 51 on the first tightening clothing piece 5 and the second hooks 61 on the second tightening clothing piece 6 are aligned pairwise so that a strap 7 may run longitudinally through the first hooks 51 and then longitudinally through second hooks 61, as shown in FIG. 9, so that the first tightening clothing piece 5 and the second tightening clothing piece 6 are strapped together. The gap between the first tightening clothing piece 5 and the second tightening clothing piece 6 may be freely adjusted by tightening or loosing the strap 7. The strap 7, therefore, provides a first means for tightening or loosing the sculpting garment 1 without replacing the clothing pieces 2, the first tightening clothing piece 5, or the second tightening clothing piece 6. On the other hand, if the strap 7 fails to provide a desired tightness or looseness, the clothing pieces 2, the first tightening clothing piece 5, or the second tightening clothing piece 6 may be replaced to better fit the wearer's body shape.

Figure 4:
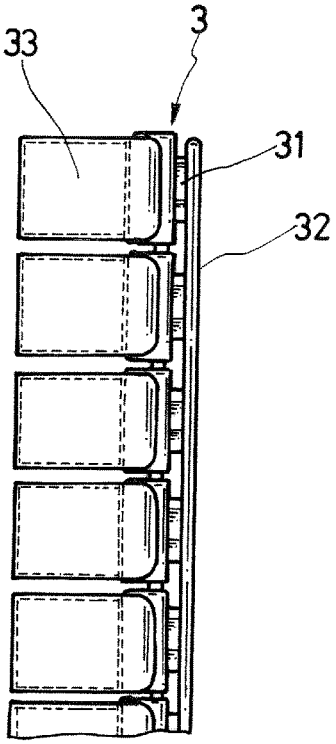
FIG. 4 is a front-view diagram showing first fasteners of the sculpting garment of FIG. 1.
Figure 5:
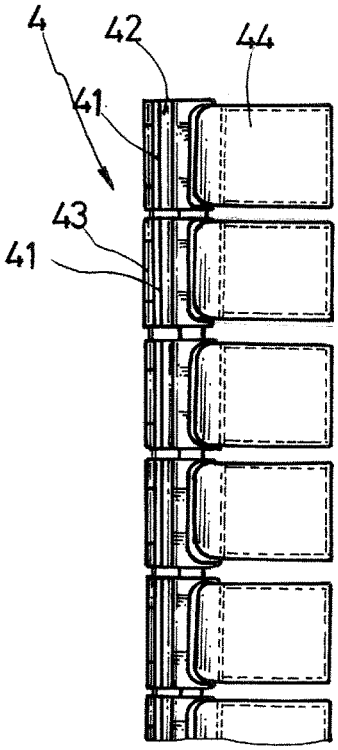
FIG. 5 is a back-view diagram showing second fasteners of the sculpting garment of FIG. 1.

As shown in FIGS. 4 and 5, the first fasteners 3 and second fasteners 4 are made of an inflexible material such as inflexible plastic material. Each first fastener 3 has a connection element 31 to a side pivotally joined to a longitudinal pin 32. When multiple first fasteners 3 are arranged sequentially longitudinally, they may share a single pin 32 or they may have separate pins 32. Each first fastener 3 has a first extension piece 33 extended laterally towards another side opposite to the connection element 31 through which each first fastener 3 is sewed to a clothing piece 2, the first tightening clothing piece 5, or the second tightening clothing piece 6. Each second fastener 4 has a trough 41 to a side, and the trough 41 has first openings 42 at both ends and a second opening 43 along a side. Each second fastener 4 has a second extension piece 44 extended laterally towards another side opposite to the trough 41 through which each second fastener 4 is sewed to a clothing piece 2, the first tightening clothing piece 5, or the second tightening clothing piece 6.

Figure 6:
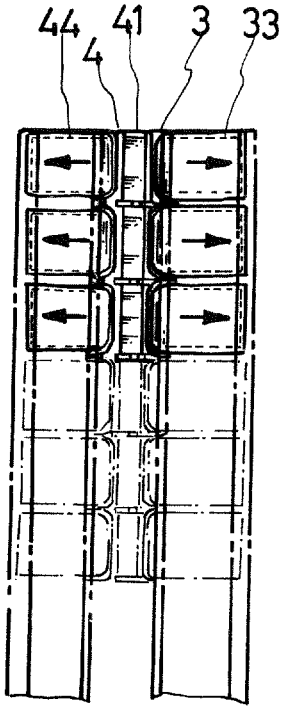
FIG. 6 is a front-view diagram showing the engagement of first and second fasteners of the sculpting garment of FIG. 1.
Figure 7:
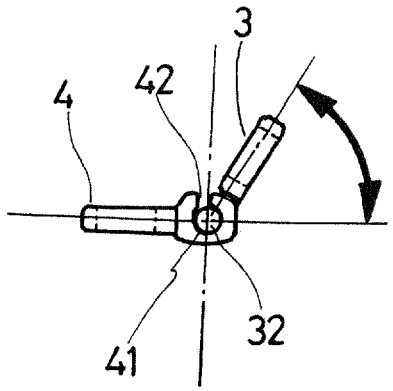
FIG. 7 is a top-view diagram showing the engagement of first and second fasteners of the sculpting garment of FIG. 1.
Figure 8:
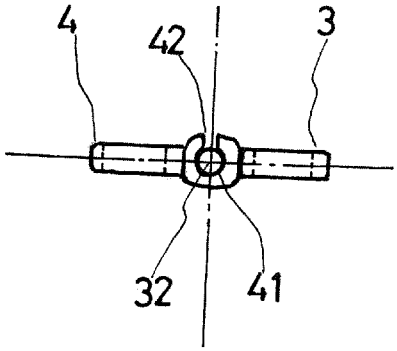
FIG. 8 is another top-view diagram showing the engagement of first and second fasteners of the sculpting garment of FIG. 1.

As shown in FIGS. 6 to 8, when a first fastener 3 and a corresponding second fastener 4 engage each other, the pin 32 of the first fastener 3 is threaded through the second fastener 4's trough 41 via the first openings 42. The pin 32 as such is slidable within the trough 41. The first fastener 3's connection element 31 then may be embedded into the second fastener 4's second opening 43, thereby reliably positioning and locking together the first and second fasteners 3 and 4.

Through their first and second fasteners 3 and 4, the clothing pieces 2 are laterally edge-by-edge pieced together into the major portion of the sculpting garment 1. Then, the dangling second fasteners 4 from an outermost clothing piece 2 may engage the first fasteners 3 along an edge of the first tightening clothing piece 5, while the dangling first fasteners 3 from another outermost clothing piece 2 may engage the second fasteners 4 along an edge of the second tightening clothing piece 6. The first tightening clothing piece 5, second tightening clothing piece 6, and clothing pieces 2 thereby join into the complete sculpting garment 1. As such, by preparing first tightening clothing piece 5, second tightening clothing piece 6, and clothing pieces 2 of various dimensions, a fitting sculpting garment 1 may be quickly produced by choosing and putting together first tightening clothing piece 5, second tightening clothing piece 6, and clothing pieces 2 of appropriate dimensions.

The gist of the present invention lies in that the first tightening clothing piece 5, second tightening clothing piece 6, and clothing pieces 2 have longitudinally arranged first fasteners 3 and second fasteners 4 along their longitudinal edges. The first tightening clothing piece 5, second tightening clothing piece 6, and clothing pieces 2 are thereby may be quickly assembled into a sculpting garment 1 fitting nicely over a wearer's body and disassembled. The sculpting garment 1's production cost and effort is as such greatly reduced.

Additionally, the first fasteners 3 and second fasteners 4 are made of an inflexible material such as inflexible plastic material. As the sculpting garment 1 is assembled and the first fasteners 3 and second fasteners 4 are engaged, they jointly form a number of longitudinal rib structures to provide rigid and vertical support to the wearer's torso, thereby avoiding the embedment of metallic rods in a conventional sculpting garment.

Furthermore, each first fastener 3 and second fastener 4 is independent. When one or few of the first fasteners 3 and second fasteners 4 are broken, the other functional first fasteners 3 and second fasteners 4 may still engage with each other without affecting the assembly and disassembly function of the first tightening clothing piece 5, second tightening clothing piece 6, and clothing pieces 2.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A sculpting garment capable of quick assembly, disassembly, and replacement of clothing pieces, comprising:

a plurality of clothing pieces, where each clothing piece has a first longitudinal edge and a second longitudinal edge, a plurality of first fasteners are sequentially arranged at intervals along the first longitudinal edge, and a plurality of second fasteners are sequentially arranged at intervals along the second longitudinal edge;

a first tightening clothing piece, where a plurality of first fasteners are sequentially arranged at intervals along a longitudinal edge of the first tightening clothing piece; and a second tightening clothing piece, where a plurality of second fasteners are sequentially arranged at intervals along a longitudinal edge of the second tightening clothing piece;

wherein the clothing pieces are laterally pieced together by having adjoining clothing pieces' the first and second fasteners along their respective first and second longitudinal edges detachably engage each other;

the first fasteners of the first tightening clothing piece detachably engage dangling second fasteners on a laterally outermost clothing piece;

the second fasteners of the second tightening clothing piece detachably engage dangling first fasteners on another laterally outermost clothing piece;

the first and second fasteners are made of an inflexible material; and the engaged first and second fasteners between clothing pieces, between clothing pieces and first and second tightening clothing pieces jointly form a plurality of longitudinal rib structures to provide rigid and vertical support to a wearer's torso;

wherein each first tightening clothing piece further has a plurality of first hooks that are arranged sequentially at intervals along another longitudinal edge of the first tightening clothing piece opposite to the first fasteners; a plurality of second hooks are sequentially arranged at intervals along another longitudinal edge of the second tightening clothing piece; and a strap runs sequentially through the first and second hooks to join the first and second tightening clothing pieces together.

2. The sculpting garment according to claim 1, wherein the first tightening clothing piece has a first cup along an upper edge; the first cup is connected to a first shoulder strap; the second tightening clothing piece has second cup along its upper edge; and the second cup is connected to a second shoulder strap.

3. The sculpting garment according to claim 1, wherein each clothing piece has an upper edge and a lower edge; the upper edge has a greater width than that of the lower edge; a middle section of each clothing piece has a smaller width than that of the lower edge.

4. The sculpting garment according to claim 1, wherein each first fastener has a connection element to a side pivotally joined to a longitudinal pin; each second fastener has a trough to a side; the trough has first openings at both ends and a second opening along a side; the pin of each first fastener is threaded through a corresponding second fastener's trough via the first openings; each first fastener's connection element is embedded into a corresponding second fastener's second opening, thereby reliably positioning and locking together the first and second fasteners.

5. The sculpting garment according to claim 1, wherein each first fastener has a first extension piece extended laterally from a side through which each first fastener is sewed to a clothing piece, the first tightening clothing piece, or the second tightening clothing piece.

6. The sculpting garment according to claim 1, wherein each second fastener has a second extension piece extended laterally from a lateral side through which each second fastener is sewed to a clothing piece, the first tightening clothing piece, and the second tightening clothing piece.

* * * * *